US007842141B2

(12) United States Patent
Kimura et al.

(10) Patent No.: US 7,842,141 B2
(45) Date of Patent: Nov. 30, 2010

(54) STAINLESS-STEEL PIPE FOR OIL WELL AND PROCESS FOR PRODUCING THE SAME

(75) Inventors: Mitsuo Kimura, Tokyo (JP); Takanori Tamari, Tokyo (JP); Takaaki Toyooka, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 12/416,996

(22) Filed: Apr. 2, 2009

(65) Prior Publication Data

US 2009/0272469 A1 Nov. 5, 2009

Related U.S. Application Data

(63) Continuation of application No. 10/488,980, filed as application No. PCT/JP03/07709 on Jun. 18, 2003, now abandoned.

(30) Foreign Application Priority Data

Jun. 19, 2002 (JP) ..... 2002-178974
Apr. 18, 2003 (JP) ..... 2003-114775
Jun. 2, 2003 (JP) ..... 2003-156234

(51) Int. Cl.
*C22C 38/42* (2006.01)
*C22C 38/44* (2006.01)
*C22C 38/46* (2006.01)
*C22C 38/58* (2006.01)

(52) U.S. Cl. ..... 148/325; 420/49; 420/53; 420/61; 420/67; 420/70; 420/91; 420/119; 420/120; 420/123

(58) Field of Classification Search ..... 148/325; 420/49, 53–55, 57, 58, 61, 67, 70, 91, 119, 420/120, 123
See application file for complete search history.

(56) References Cited

U.S. PATENT DOCUMENTS 5,110,544 A * 5/1992 Sato et al. ..... 420/69
5,496,421 A * 3/1996 Hashizume et al. ..... 148/326
5,820,699 A 10/1998 Asahi et al.
5,985,209 A 11/1999 Kimura et al.
6,793,744 B1 9/2004 Jung

FOREIGN PATENT DOCUMENTS

| | | | | |
|---|---|---|---|---|
| EP | 0 472 305 | A1 | | 2/1992 |
| EP | 0 649 915 | A1 | | 4/1995 |
| EP | 0 798 394 | A1 | | 10/1997 |
| JP | 02-243739 | A | | 9/1990 |
| JP | 03-075335 | A | | 3/1991 |
| JP | 03-120337 | A | | 5/1991 |
| JP | 05-112850 | A | | 5/1993 |
| JP | 08-120345 | A | | 5/1996 |
| JP | 08-246107 | A | | 9/1996 |
| JP | 09-268349 | A | | 10/1997 |
| JP | 10-001755 | A | | 1/1998 |
| JP | 2814528 | B2 | | 10/1998 |
| JP | 11-310855 | A | | 11/1999 |
| JP | 2001-179485 | A | | 7/2001 |
| JP | 2001179485 | A | * | 7/2001 |
| JP | 2002-004009 | A | | 1/2002 |
| JP | 3251648 | B2 | | 1/2002 |
| JP | 2002-060910 | A | | 2/2002 |
| JP | 2002-129278 | A | | 5/2002 |
| WO | 03/033754 | A1 | | 4/2003 |

OTHER PUBLICATIONS

Machine translation of JP 2001-179485 published Jul. 3, 2001.*
Written translation of JP-A-13179485 published Jul. 3, 2001.*
ASM International, Materials Park, Ohio, Metallographer's Guide: Practices and Procedures for Irons and Steels, Chapter 1, "Introduction to Steels and Cast Irons," p. 3, Table 1.1, 1999.

* cited by examiner

*Primary Examiner*—George Wyszomierski
*Assistant Examiner*—Tima M McGuthry-Banks
(74) *Attorney, Agent, or Firm*—DLA Piper LLP (US)

(57) ABSTRACT

A steel composition contains: 0.05% or less of C; 0.5% or less of Si; 0.20% to 1.80% of Mn; 0.03% or less of P; 0.005% or less of S; 14.0% to 18.0% of Cr; 5.0% to 8.0% of Ni; 1.5% to 3.5% of Mo; 0.5% to 3.5% of Cu; 0.05% or less of Al; 0.20% or less of V; 0.01% to 0.15% of N; and 0.006% or less of O on a mass basis, and satisfies the following expressions: $Cr+0.65Ni+0.6Mo+0.55Cu-20C \geqq 18.5$ and $Cr+Mo+0.3Si-43.5C-0.4Mn-Ni-0.3Cu-9N \leqq 11$ (where Cr, Ni, Mo, Cu, C, Si, Mn, and N represent their respective contents (mass %)). After such a steel pipe material is formed into a steel pipe, the steel pipe is quenched by cooling after heating to a temperature of the $A_{C3}$ transformation point or more and tempered at a temperature of the $A_{C1}$ transformation point or less.

22 Claims, No Drawings

STAINLESS-STEEL PIPE FOR OIL WELL AND PROCESS FOR PRODUCING THE SAME

RELATED APPLICATIONS

This application is a continuation of U.S. application Ser. No. 10/488,980, filed Mar. 10, 2004, now abandoned, which is a §371 of International Application No. PCT/JP2003/007709, with an international filing date of Jun. 18, 2003 (WO 2004/001082 A1, published Dec. 31, 2003), which is based on Japanese Patent Application Nos. 2002-178974, filed Jun. 19, 2002, 2003-114775, filed Apr. 18, 2003, and 2003-156234, filed Jun. 2, 2003.

TECHNICAL FIELD

This disclosure relates to steel pipes for oil country tubular goods used in crude oil wells and natural gas wells. In particular, this disclosure relates to an improvement of corrosion resistance to extremely severe, corrosive environment in which carbon dioxide gas ($CO_2$), chloride ions ($Cl^-$), and the like are present.

BACKGROUND

Deep oil wells, which have not conventionally been regarded at all, and corrosive sour gas wells, the development of which was abandoned for a time, have recently been developed increasingly on a world scale to cope with increase of crude oil price and anticipated oil resource depletion in the near future. These oil wells and gas wells generally lie at great depths in a severe, corrosive environment of a high-temperature atmosphere containing corrosive substances, such as $CO_2$ and $Cl^-$. Accordingly, steel pipes for oil country tubular goods used for digging such an oil or gas well have to be highly strong and corrosion-resistant.

In general, highly $CO_2$ corrosion-resistant 13%-Cr martensitic stainless steel pipes are used in oil wells and gas wells whose atmospheres contain $CO_2$, $Cl^-$, or the like. However, conventional martensitic stainless steels cannot wear in environments at high temperatures of more than 100° C. containing a large amount of $Cl^-$. Accordingly, two-phase stainless steel pipes are used in oil wells requiring corrosion resistance. Unfortunately, the two-phase stainless steel pipes contain large amounts of alloying elements to reduce the hot workability. Consequently, they must be manufactured only by special heat treatment due to their reduced hot workability, and besides, they are disadvantageously expensive. Accordingly, an inexpensive 13%-Cr martensitic stainless steel-based pipe for oil country tubular goods having a superior hot workability and $CO_2$ corrosion resistance has been strongly desired. On the other hand, oil well development in cold districts has recently become active, and, accordingly, superior toughness at low temperatures is often required in addition to high strength.

To these demands, improved martensitic stainless steels (or steel pipes) based on a 13%-Cr martensitic stainless steel (or steel pipe), having an enhanced corrosion resistance have been proposed in, for example, Japanese Unexamined Patent Application Publication Nos. 8-120345, 9-268349, and 10-1755 and Japanese Patent Nos. 2814528 and 3251648.

Japanese Unexamined Patent Application Publication No. 8-120345 has disclosed a method for manufacturing a seamless martensitic stainless steel pipe having a superior corrosion resistance. For a steel composition of a 13%-Cr martensitic stainless steel pipe, the C content is limited to the range of 0.005% to 0.05%, 2.4% to 6% of Ni and 0.2% to 4% of Cu are added in combination, and 0.5% to 3% of Mo is further added. Furthermore, $Ni_{eq}$ is set at 10.5 or more. This steel material is subjected to hot working, subsequently cooled at air-cooling speed or more, and then tempered. Alternatively, after being cooled, the steel material is further heated to a temperature between $A_{C3}$ transformation point+10° C. and $A_{C3}$ transformation point+200° C., or a temperature between $A_{C1}$ transformation point and $A_{C3}$ transformation point, subsequently cooled to room temperature at air-cooling speed or more, and then tempered. According to this method, a seamless martensitic stainless steel pipe is achieved which has a high strength of the grade API-C95 or grater, corrosion resistance in environments at 180° C. or more containing $CO_2$, and SCC resistance.

Japanese Unexamined Patent Application Publication No. 9-268349 has disclosed a method for manufacturing a martensitic stainless steel having a superior stress-corrosion cracking resistance to sulfides. In this method, a steel composition of a 13%-Cr martensitic stainless steel contains 0.005% to 0.05% of C, 0.005% to 0.1% of N, 3.0% to 6.0% of Ni, 0.5% to 3% of Cu, and 0.5% to 3% of Mo. After hot working and being left to cool down to room temperature, this steel material is heated to a temperature between ($A_{C1}$ point+10° C.) and ($A_{C1}$ point+40° C.) for 30 to 60 minutes, then cooled to a temperature of Ms point or less, and tempered at a temperature of $A_{C1}$ point or less. Thus, the resulting steel has a structure in which tempered martensite and 20 percent by volume or more of γ phase are mixed. According to this method, the sulfide stress-corrosion cracking resistance is remarkably enhanced by forming a martensitic structure containing 20 percent by volume or more of γ phase.

Japanese Unexamined Patent Application Publication No. 10-1755 has disclosed a martensitic stainless steel containing 10% to 15% of Cr, having a superior corrosion resistance and sulfide stress-corrosion cracking resistance. This martensitic stainless steel has a composition in which the Cr content is set at 10% to 15%; the C content is limited to the range of 0.005% to 0.05%; 4.0% or more of Ni and 0.5% to 3% of Cu are added in combination; and 1.0% to 3.0% of Mo is further added. Furthermore, $Ni_{eq}$ of the composition is set at −10 or more. The structure of the martensitic stainless steel contains a tempered martensitic phase, a martensitic phase, and a residual austenitic phase. The total percentage of the tempered martensitic phase and the martensitic phase is set in the range of 60% to 90%. According to this disclosure, corrosion resistance and sulfide stress-corrosion cracking resistance in environments where wet carbon dioxide gas or wet hydrogen sulfide is present are enhanced.

Japanese Patent No. 2814528 relates to an oil well martensitic stainless steel product having a superior sulfide stress-corrosion cracking resistance. This steel product has a steel composition containing more than 15% and 19% or less of Cr, 0.05% or less of C, 0.1% or less of N, 3.5% to 8.0% of Ni, and 0.1% to 4.0% of Mo, and simultaneously satisfying the relationships: $30Cr+36Mo+14Si-28Ni \leqq 455(\%)$; and $21Cr+25Mo+17Si+35Ni \leqq 731(\%)$. According to this disclosure, the resulting steel product exhibits a superior corrosion resistance in severe environments in oil wells where chloride ions, carbon dioxide gas, and a small amount of hydrogen sulfide gas are present.

Japanese Patent No. 3251648 relates to a precipitation hardening martensitic stainless steel having superior strength and toughness. This martensitic stainless steel has a steel composition containing 10.0% to 17% of Cr, 0.08% or less of C, 0.015% or less of N, 6.0% to 10.0% of Ni, 0.5% to 2.0% of Cu, and 0.5% to 3.0% of Mo. The structure of the steel is formed by 35% or more cold working and annealing and it has a mean crystal grain size of 25 μm or less and precipitates with a particle size of $5\times10^{-2}$ μm or more in the matrix. The number of the precipitates is limited to $6\times10^{6}$ per square millimeter or less. According to this disclosure, a high-strength precipitation hardening martensitic stainless steel in which toughness degradation does not occur can be achieved by forming a structure containing fine crystal grains and less precipitation.

However, improved 13%-Cr martensitic stainless steel pipes manufactured by the techniques of Japanese Unexamined Patent Application Publication Nos. 8-120345, 9-268349, and 10-1755 and Japanese Patent Nos. 2814528 and 3251648 do not stably exhibit desired corrosion resistance in severe, corrosive environments at temperatures of more than 180° C. containing $CO_2$, $Cl^-$, or the like.

In view of the circumstances of the known arts stated above, this disclosure has been achieved. The object of this disclosure is to provide an inexpensive, corrosion-resistant stainless steel pipe for oil country tubular goods, preferably a high-strength stainless steel pipe for oil country tubular goods, having a superior hot workability and exhibiting a superior $CO_2$ corrosion resistance even in severe, corrosive environments at temperatures of more than 180° C. containing $CO_2$, $Cl^-$, or the like.

SUMMARY

We provide:

(1) A corrosion-resistant stainless steel pipe for oil country tubular goods having a steel composition comprising, on a mass basis, 0.05% or less of C; 0.50% or less of Si; 0.20% to 1.80% of Mn; 0.03 or less of P; 0.005% or less of S; 14.0% to 18.0% of Cr; 5.0% to 8.0% of Ni; 1.5% to 3.5% of Mo; 0.5% to 3.5% of Cu; 0.05% or less of Al; 0.20% or less of V; 0.01% to 0.15% of N; 0.006% or less of O and the balance being Fe and incidental impurities. The composition satisfies expressions (1) and (2):

$$Cr+0.65Ni+0.6Mo+0.55Cu+20C\geqq18.5 \quad (1)$$

$$Cr+Mo+0.3Si-43.5C-0.4Mn-Ni-0.3Cu-9N\leqq11 \quad (2)$$

where Cr, Ni, Mo, Cu, C, Si, Mn, and N represent their respective contents on a mass % basis.

(2) A corrosion-resistant stainless steel pipe for oil country tubular goods according to (1) in which the composition further contains at least one element of 0.20% or less of Nb and 0.30% or less of Ti on a mass basis.

(3) A corrosion-resistant stainless steel pipe for oil country tubular goods according to (1) or (2) in which the composition further contains at least one element selected from the group consisting of 0.20% or less of Zr, 0.01% or less of B, and 3.0% or less of W on a mass basis.

(4) A corrosion-resistant stainless steel pipe for oil country tubular goods according to any one of (1) to (3) in which the composition further contains 0.0005% to 0.01% of Ca on a mass basis.

(5) A stainless steel pipe for oil country tubular goods according to any one of (1) to (4) and whose structure includes 5 to 25 percent by volume of a residual austenitic phase and the balance being a martensitic phase.

(6) A corrosion-resistant stainless steel pipe for oil country tubular goods according to any one of (1) to (4) and whose structure includes 5 to 25 percent by volume of a residual austenitic phase, 5 percent by volume or less of a ferrite phase, and the balance being a martensitic phase.

(7) A method for manufacturing a corrosion-resistant stainless steel pipe for oil country tubular goods including the steps of: forming a steel pipe from a steel pipe material having a composition; quenching the steel pipe by heating the steel pipe to a temperature of the $A_{C3}$ transformation point thereof or more and subsequently cooling to room temperature at air-cooling speed or more; and then tempering the steel pipe at a temperature of the $A_{C1}$ transformation point thereof or less. The composition contains, on a mass basis, 0.05% or less of C; 0.50% or less of Si; 0.20% to 1.80% of Mn; 0.03 or less of P; 0.005% or less of S; 14.0% to 18.0% of Cr; 5.0% to 8.0% of Ni; 1.5% to 3.5% of Mo; 0.5% to 3.5% of Cu; 0.05% or less of Al; 0.20% or less of V; 0.01% to 0.15% of N; 0.006% or less of O, and the balance being Fe and incidental impurities, and the composition satisfies expressions (1) and (2):

$$Cr+0.65Ni+0.6Mo+0.55Cu+20C\geqq18.5 \quad (1)$$

$$Cr+Mo+0.3Si-43.5C-0.4Mn-Ni-0.3Cu-9N\leqq11 \quad (2)$$

where Cr, Ni, Mo, Cu, C, Si, Mn, and N represent their respective contents.

(8) A method for manufacturing a stainless steel pipe for oil country tubular goods according to (7) in which the composition further contains at least one element of 0.20% or less of Nb and 0.30% or less of Ti on a mass basis.

(9) A method for manufacturing a stainless steel pipe for oil country tubular goods according to (8) in which the quenching includes heating to a temperature in the range of 800 to 1100° C. and cooling to room temperature at air-cooling speed or more, and the tempering is performed at a temperature in the range of 500 to 630° C.

(10) A method for manufacturing a stainless steel pipe for oil country tubular goods according to any one of (7) to (9) in which the composition further contains at least one element selected from the group consisting of 0.20% or less of Zr, 0.01% or less of B, and 3.0% or less of W on a mass basis.

(11) A method for manufacturing a stainless steel pipe for oil country tubular goods according to any one of (7) to (10) in which the composition further contains 0.0005% to 0.01% of Ca on a mass basis.

(12) A method for manufacturing a corrosion-resistant seamless stainless steel pipe for oil country tubular goods, including the steps of: forming a steel pipe from a steel pipe material having a composition by hot working; cooling the steel pipe to room temperature at air-cooling speed or more, or quenching the steel pipe by further heating to a temperature of the $A_{C3}$ transformation point thereof or more and cooling to room temperature at air-cooking speed or more; and then tempering the steel pipe at a temperature of the $A_{C1}$ transformation point thereof or less. The composition contains, on a mass basis, 0.05% or less of C; 0.50% or less of Si; 0.20% to 1.80% of Mn; 0.03 or less of P; 0.005% or less of S; 14.0% to 18.0% of Cr; 5.0% to 8.0% of Ni; 1.5% to 3.5% of Mo; 0.5% to 3.5% of Cu; 0.05% or less of Al; 0.20% or less of V; 0.01% to 0.15% of N; 0.006% or less of O, and the balance being Fe and incidental impurities, and the composition satisfies expressions (1) and (2):

$$Cr+0.65Ni+0.6Mo+0.55Cu+20C\geqq18.5 \quad (1)$$

$$Cr+Mo+0.3Si-43.5C-0.4Mn-Ni-0.3Cu-9N\leqq11 \quad (2)$$

where Cr, Ni, Mo, Cu, C, Si, Mn, and N represent their respective contents on a mass % basis.

(13) A method for manufacturing a seamless stainless steel pipe for oil country tubular goods according to (12) in which the composition further contains at least one element of 0.20% or less of Nb and 0.30% or less of Ti on a mass basis.

(14) A method for manufacturing a seamless stainless steel pipe for oil country tubular goods according to (13) in which the quenching includes heating to a temperature in the range of 800 to 1100° C. and cooling to room temperature at air-cooling speed or more, and the tempering is performed at a temperature in the range of 500 to 630° C.

(15) A method for manufacturing a seamless stainless steel pipe for oil country tubular goods according to any one of (12) to (14) in which the composition further contains at least one element selected from the group consisting of 0.20% or less of Zr, 0.01% or less of B, and 3.0% or less of W on a mass basis.

(16) A method for manufacturing a seamless stainless steel pipe for oil country tubular goods according to any one of (12) to (15) in which the composition further contains 0.0005% to 0.01% of Ca on a mass basis.

DETAILED DESCRIPTION

"High strength" refers to a strength (yield strength: 550 MPa or more) that conventional 13%-Cr martensitic stainless steel pipes for oil country tubular goods have, and preferably to a yield strength of 654 MPa or more.

To accomplish the above-described objects, we have conducted intensive research on the effects of alloying element contents to corrosion resistance in corrosive environments at high temperatures in the range of more than 180° C. to 230° C. containing $CO_2$, $Cl^-$, or the like, based on the compositions of the improved 13%-Cr martensitic stainless steel pipes.

As a result, it has been found that both of a favorable hot workability and a superior corrosion resistance in severe, corrosive environments can be ensured by reducing the C content to be lower than that of the known 13%-Cr martensitic stainless steels and adding suitable amounts of Ni, Mo, and Cu to adjust alloying element contents, so as to satisfy following expressions (1) and (2):

$$Cr+0.65Ni+0.6Mo+0.55Cu-20C \geqq 18.5 \quad (1)$$

$$Cr+Mo+0.3Si-43.5C-0.4Mn-Ni-0.3Cu-9N \leqq 11 \quad (2)$$

wherein Cr, Ni, Mo, Cu, C, Si, Mn, and N represent their respective contents (mass %). Furthermore, it has been found that a high strength of 654 MPa or more in terms of yield strength can be ensured.

This disclosure has been completed based on these findings.

The reason why the steel compositions are controlled will now be explained. Hereinafter, mass percent is expressed by simply %.

C: 0.05% or Less

C is an essential element relating to the strength of martensitic stainless steel, but a C content of more than 0.05% promotes sensitization at the stage of tempering due to the presence of Ni. To prevent the sensitization at the stage of tempering, the C content is limited to 0.05% or less. In view of corrosion resistance, it is preferable that the C content be set as lower as possible. Preferably, it is 0.03% or less. More preferably, it is set in the range of 0.01% to 0.03%.

Si: 0.50% or Less

The element Si serves as a deoxidizer, and, preferably, its content is 0.05% or more. However, a content of more than 0.50% reduces the $CO_2$ corrosion resistance and further reduces the hot workability. Accordingly, the Si content is limited to 0.50% or less. Preferably, it is set in the range of 0.10% to 0.30%.

Mn: 0.20% to 1.80%

The element Mn enhances steel strength. To ensure a strength desired, the Mn content has to be 0.20% or more. However, a content of more than 1.80% negatively affects the toughness. Accordingly, the Mn content is limited to the range of 0.20% to 1.80%. Preferably, it is set in the range of 0.20% to 1.00%. More preferably, it is set in the range of 0.20% to 0.80%.

P: 0.03% or Less

The element P negatively affects the $CO_2$ corrosion resistance, $CO_2$ stress-corrosion cracking resistance, pitting corrosion resistance, and sulfide stress-corrosion cracking resistance, and it is preferable that the P content be reduced as low as possible. However, an excessive reduction of P content increases cost. Accordingly, the P content is limited to 0.03% or less so as to allow industrial production at a low cost and prevent the degradation of $CO_2$ corrosion resistance, $CO_2$ stress-corrosion cracking resistance, pitting corrosion resistance, and sulfide stress-corrosion resistance. Preferably, it is set at 0.02% or less.

S: 0.005% or Less

The element S seriously reduces hot workability in manufacture of pipes, and the S content is, preferably, as low as possible. A S content of 0.005% or less makes it possible to manufacture pipes through a common process, and, therefore, the S content is limited to 0.005% or less. Preferably, it is set at 0.003% or less.

Cr: 14.0% to 18.0%

The element Cr forms a protective film on the surface of steel to increase the corrosion resistance, and particularly to increase the $CO_2$ corrosion resistance and $CO_2$ stress-corrosion cracking resistance. A Cr content of 14.0% or more is necessary from the viewpoint of increasing the corrosion resistance at high temperatures. However, a content of more than 18.0% reduces the hot workability. Accordingly, the Cr content is limited to the range of 14.0% to 18.0%. Preferably, it is set in the range of 14.5% to 17.5%.

Ni: 5.0% to 8.0%

The element Ni strengthens the protective film on the surface of steel to enhance the $CO_2$ corrosion resistance and $CO_2$ stress-corrosion cracking resistance, pitting corrosion resistance, and sulfide stress-corrosion cracking resistance. Furthermore, it has the effect of a solid solution strengthening and, accordingly, increases steel strength. These effects are exhibited when the Ni content is 5.0% or more. However, a content of more than 8.0% reduces the stability of the martensitic structure to decrease the strength. Accordingly, the Ni content is limited to the range of 5.0% to 8.0%. Preferably, it is set in the range of 5.5% to 7.0%.

Mo: 1.5% to 3.5%

The element Mo enhances the resistance to pitting by $Cl^-$, and a content of 1.5% or more is necessary. While a content of less than 1.5% does not efficiently achieve the corrosion resistance in severe, corrosive environments at high temperatures, a content of more than 3.5% causes the formation of 6-ferrite to reduce the hot workability, $CO_2$ corrosion resistance, and $CO_2$ stress-corrosion cracking resistance and increases cost. Accordingly, the Mo content is limited to the range of 1.5% to 3.5%. Preferably, it is set in the range of 1.5% to 2.5%.

Cu: 0.5% to 3.5%

The element Cu strengthens the protective film on the surface of the steel to prevent from hydrogen-penetration into the steel, thereby enhancing the sulfide stress-corrosion cracking resistance. This effect is achieved when the Cu content is 0.5% or more. However, a content of more than 3.5% allows CuS to precipitate in grain boundaries to reduce the hot workability. Accordingly, the Cu content is limited to the range of 0.5% to 3.5%. Preferably, it is set in the range of 0.5% to 2.5%.

Al: 0.05% or Less

The element Al has a strong effect of deoxidation, but a content of more than 0.05% negatively affects the toughness of the steel. Accordingly, the Al content is limited to 0.05% or less. Preferably, it is set in the range of 0.01% to 0.03%.

V: 0.20% or Less

The element V enhances the strength of steel and also has the effect of improving the stress-corrosion cracking resistance. These effects are noticeably exhibited when the V content is 0.03% or more. However, a content of more than 0.20% reduces the toughness. Accordingly, the V content is limited to 0.20% or less. Preferably, it is set in the range of 0.03% to 0.08%.

N: 0.01% to 0.15%

The element N extremely enhances the pitting corrosion resistance. This effect is exhibited when the N content is 0.01% or more. However, a content of more than 0.15% allows the formation of various nitrides to reduce the toughness. Accordingly, the N content is limited to the range of 0.01% to 0.15%. Preferably, it is set in the range of 0.03% to 0.15%, and more preferably in the range of 0.03% to 0.08%.

O: 0.006% or Less

The element O is present in oxide forms in steel and negatively affects various characteristics. It is, therefore, preferable to be reduced as low as possible. In particular, an O content of more than 0.006% seriously reduces the hot workability, $CO_2$ stress-corrosion cracking resistance, pitting corrosion resistance, sulfide stress-corrosion cracking resistance, and toughness. Accordingly, the O content is limited to 0.006% or less.

The above-described basic composition may further contain at least either 0.20% or less of Nb or 0.30% or less of Ti.

Both the elements Nb and Ti enhance the strength and the toughness, and particularly increase the strength remarkably by tempering at a relatively low temperature in the range of 500 to 630° C. This effect is noticeably exhibited when the Nb and Ti contents are 0.02% or more and 0.01% or more, respectively. On the other hand, a Nb content of more than 0.20% and a Ti content of more than 0.30% reduce the toughness. In addition, Ti has the effect of improving the stress-corrosion cracking resistance. Accordingly, the Nb content is preferably limited to 0.20% or less, and the Ti content, 0.30% or less.

The above-described composition may further contain at least one element selected from the group consisting of 0.20% or less of Zr, 0.01% or less of B, and 3.0% or less of W.

Zr, B, and W each increases the strength, and at least one of them may be added if necessary. In addition to the effect of increasing the strength, Zr, B, and W can improve the stress-corrosion cracking resistance. These effects are noticeably exhibited when the composition contains 0.01% or more of Zr, 0.0005% or more of B, or 0.1% or more of W. On the other hand, if the composition contains more than 0.20% of Zr, more than 0.01% of B, or more than 3.0% of W, the toughness is reduced. Accordingly, the Zr content is preferably limited to 0.20% or less; the B content, 0.01% or less; and the W content, 3.0% or less.

The composition may further contain 0.0005% to 0.01% of Ca.

The element Ca forms CaS to fix the element S and, thus, to spheroidize sulfide inclusions, thereby reducing lattice distortion of the matrix in the vicinity of the inclusions to reduce the capability of trapping hydrogen of the inclusions advantageously. This effect is achieved when the Ca content is 0.0005% or more. However, a content of more than 0.01% increases CaO, and reduces the $CO_2$ corrosion resistance and pitting resistance. Accordingly, the Ca content is preferably limited to the range of 0.0005% to 0.01%.

In addition to the above-described requirements, the each element content have to satisfy following expressions (1) and (2):

$$Cr+0.65Ni+0.6Mo+0.55Cu-20C \geqq 18.5 \quad (1)$$

$$Cr+Mo+0.3Si-43.5C-0.4Mn-Ni-0.3Cu-9N \leqq 11 \quad (2)$$

wherein Cr, Ni, Mo, Cu, C, Si, Mn, and N represent their respective contents.

By adjusting the Cr, Ni, Mo, Cu, and C contents so as to satisfy expression (1), the corrosion resistance in environments at high temperatures up to 230° C. including $CO_2$ or $Cl^-$ is remarkably increased. Also, by adjusting the Cr, Mo, Si, C, Mn, Ni, Cu, and N contents so as to satisfy expression (2), the hot workability is enhanced. P, S, and O contents are significantly reduced to enhance the hot workability. However, reducing the P, S, and O contents is not enough to ensure a hot workability sufficient to produce seamless martensitic stainless steel pipes. To ensure a hot workability sufficient to make seamless martensitic stainless steel pipes, it is important to extremely reduce the P, S, and O contents, and besides to adjust the Cr, Mo, Si, C, Mn, Ni, Cu, and N contents so as to satisfy expression (2).

The balance of the foregoing elements is Fe and incidental impurities.

Preferably, the steel pipe has a structure comprising 5% to 25% of residual austenite phase on a volume basis and the balance being a martensite phase. Alternatively, the steel pipe has a structure comprising 5% to 25% of residual austenite phase, 5% or less of ferrite phase, and the balance being a martensite phase on a volume basis.

Although the structure of the steel pipe is essentially composed of the martensite phase, the martensite phase, preferably, contains 5% to 25% of a residual austenite phase, or further contains 5% or less of a ferrite phase, on a volume basis.

By allowing 5 percent by volume or more of residual austenite phase to be present, a high toughness can be achieved. However, more than 25 percent by volume of residual austenite phase reduces the strength. Accordingly, it is preferable that the percentage of the residual austenite phase is set in the range of 5 to 25 percent by volume. In addition, to enhance the corrosion resistance, it is preferable that 5 percent by volume or less of ferrite phase is allowed to be present. However, more than 5 percent by volume of ferrite phase remarkably reduces the hot workability. Accordingly, it is preferable that the percentage of the ferrite phase is set at 5 percent by volume or less.

A method for manufacturing the steel pipe will now be described taking a seamless steel pipe as an example.

First, it is preferable that a molten steel having the above-described composition be melted by a conventional steel making process using a converter, an electric furnace, a vacuum melting furnace, or the like, and then formed into a steel pipe material, such as, a billet by a conventional method, such as continuous casting or ingot making-slabbing. Then, the steel pipe material is heated and subjected to hot working to make a pipe by a common manufacturing process, such as that of Mannesmann-plug mill or Mannesmann-mandrel mill. Thus a seamless steel pipe with a desired size is yielded. After pipe making, the resulting seamless steel pipe is preferably cooled to room temperature at air-cooling speed or more.

The seamless steel pipe having the above-described steel composition can be given a structure mainly composed of a martensite phase by cooling at air-cooling speed or more after hot working. After the cooling at air-cooling speed or more, preferably, quenching is performed in which the steel pipe is heated again to a temperature of the $A_{C3}$ transformation point or more and cooled to room temperature at air-cooling speed or more. Thus, the martensitic structure can be refined and the toughness of the steel can be increased.

Preferably, the quenched seamless steel pipe is subjected to tempering by being heated to a temperature of the $A_{C1}$ transformation point or less. By heating to a temperature of the $A_{C1}$ transformation point or less, preferably to 400° C. or more, for tempering, the resultant structure comprises a tempered martensite phase, further comprises a residual austenite phase, or still further comprises a small amount of ferrite phase in some cases. Thus, the resulting seamless steel pipe exhibits a desired strength, a desired toughness, and a desired, superior corrosion resistance.

Only tempering may be performed without quenching.

The description above illustrates a steel pipe taking the seamless steel pipe as an example, but it is not limited to this form. A steel pipe material having the composition within the scope may result in an electric welded steel pipe or a UOE steel pipe used as a steel pipe for oil country tubular goods through a conventional process. However, for the electric welded steel tube and UOE steel pipe, it is preferable that, after pipe making, the pipe is quenched by heating the pipe again to a temperature of the $A_{C3}$ transformation point or more and cooling to room temperature at air-cooling speed or more, and is subsequently tempered at a temperature of the $A_{C1}$ transformation point or less.

In the case of a steel pipe having a composition containing at least one element of Nb and Ti, quenching includes heating to a temperature of 800 to 1100° C., and cooling to room temperature at air-cooling speed or more. Also, tempering is preferably performed at a temperature in the range of 500 to 630° C. By subjecting the steel pipe having the composition containing at least one element of Nb and Ti to these quenching and tempering, a sufficient amount of fine precipitates can occur to achieve a high strength of 654 MPa or more in terms of yield strength.

A quenching temperature of less than 800° C. does not sufficiently achieve the effect of tempering to provide a desired strength. On the other hand, a quenching temperature of more than 1100° C. coarsens the crystal grains to reduce the toughness of the steel. While a tempering temperature of less than 500° C. does not precipitate a sufficient amount of precipitations, a tempering temperature of more than 630° C. remarkably reduces the strength of the steel.

EXAMPLES

This disclosure will be further described in detail with reference to Examples.

Example 1

After degassing, each molten steel having a composition shown in Table 1 was cast into a steel ingot of 100 kgf (980 N). The ingot was subjected to hot working to make a pipe with a model seamless rolling mill, followed by air cooling to yield a seamless steel pipe with an outer diameter of 3.3 in. by a thickness of 0.5 in.

The hot workability was evaluated by visually observing the presence of cracks in the internal and external surfaces of the resulting seamless steel pipe as air-cooled after pipe making.

The seamless steel pipe was cut into a test piece. The test piece was heated at 920° C. for 1 hour and then water-cooled. The test piece was further subjected to tempering at 600° C. for 30 minutes. It was ensured that quenching was performed on each sample at a temperature of its $A_{C3}$ transformation point or more, and that tempering was performed at a temperature of its $A_{C1}$ transformation point or less. The quench-tempered test piece was machined into a corrosion-test piece of 3 mm in thickness by 30 mm in width by 40 mm in length, followed by a corrosion test. Some of the steel pipe samples were subjected to only tempering without quenching.

In the corrosion test, the test piece was immersed in a test solution being 20% NaCl aqueous solution placed in an autoclave (solution temperature: 230° C., $CO_2$ gas atmosphere at a pressure of 100 atmospheres) and was allowed to keep for 2 weeks.

The test piece after the corrosion test was weighed, and the corrosion rate was obtained from the difference between the weight of the test piece before the test and that after the test. The surface of the corrosion test piece after the test was observed to check for the occurrence of pitting with a loupe of a magnification of 10 times.

The results are shown in Table 2.

TABLE 1

| Steel | Chemical compositions (mass %) | | | | | | | | | | |
|---|---|---|---|---|---|---|---|---|---|---|---|
| No. | C | Si | Mn | P | S | Al | Cr | Ni | Mo | Cu | V |
| A | 0.019 | 0.19 | 0.48 | 0.02 | 0.001 | 0.01 | 14.8 | 5.19 | 1.60 | 0.65 | 0.049 |
| B | 0.024 | 0.20 | 0.44 | 0.02 | 0.001 | 0.01 | 14.9 | 5.50 | 1.50 | 0.59 | 0.051 |
| C | 0.015 | 0.24 | 0.46 | 0.03 | 0.001 | 0.02 | 15.3 | 6.12 | 2.04 | 1.05 | 0.059 |
| D | 0.025 | 0.22 | 0.50 | 0.01 | 0.002 | 0.01 | 15.1 | 5.59 | 2.49 | 1.63 | 0.048 |
| E | 0.027 | 0.20 | 0.42 | 0.01 | 0.001 | 0.02 | 15.5 | 6.27 | 1.75 | 0.77 | 0.040 |
| F | 0.024 | 0.21 | 0.40 | 0.02 | 0.001 | 0.01 | 16.2 | 5.93 | 1.66 | 1.14 | 0.041 |
| G | 0.020 | 0.26 | 0.41 | 0.01 | 0.001 | 0.01 | 16.5 | 6.05 | 2.17 | 0.88 | 0.030 |
| H | 0.016 | 0.33 | 0.40 | 0.01 | 0.001 | 0.02 | 16.9 | 5.99 | 1.52 | 1.02 | 0.052 |

TABLE 1-continued

| | | | | | | | | | | | |
|---|---|---|---|---|---|---|---|---|---|---|---|
| I | 0.026 | 0.28 | 0.48 | 0.01 | 0.001 | 0.01 | 17.3 | 6.54 | 1.69 | 0.64 | 0.049 |
| J | 0.017 | 0.27 | 0.49 | 0.01 | 0.001 | 0.01 | 17.7 | 7.05 | 1.53 | 0.85 | 0.042 |
| K | 0.034 | 0.27 | 0.50 | 0.02 | 0.001 | 0.02 | 17.4 | 5.58 | 2.87 | 0.67 | 0.046 |
| L | 0.022 | 0.26 | 0.45 | 0.02 | 0.001 | 0.01 | 13.8 | 6.19 | 1.68 | 0.71 | 0.055 |
| M | 0.045 | 0.31 | 0.49 | 0.01 | 0.002 | 0.01 | 14.6 | 5.11 | 1.55 | 0.59 | 0.048 |
| N | 0.020 | 0.26 | 0.42 | 0.03 | 0.002 | 0.02 | 14.7 | 4.55 | 1.53 | 0.69 | 0.063 |
| O | 0.016 | 0.33 | 0.44 | 0.01 | 0.001 | 0.01 | 14.8 | 5.27 | 0.56 | 0.73 | 0.065 |
| P | 0.021 | 0.21 | 0.44 | 0.02 | 0.001 | 0.02 | 17.1 | 5.15 | 1.96 | 0.57 | 0.056 |
| Q | 0.026 | 0.35 | 0.39 | 0.02 | 0.001 | 0.02 | 14.6 | 5.19 | 1.64 | 0.26 | 0.045 |

| Steel | Chemical compositions (mass %) | | | Expression | Expression | |
|---|---|---|---|---|---|---|
| No. | N | O | Other | (1)* | (2)** | Remarks |
| A | 0.059 | 0.0019 | | 19.11 | 9.5225 | Example |
| B | 0.062 | 0.0025 | Nb: 0.026 | 19.22 | 9.005 | Example |
| C | 0.043 | 0.0037 | Zr: 0.017 | 20.78 | 9.7535 | Example |
| D | 0.072 | 0.0021 | Ti: 0.034 | 20.62 | 9.6415 | Example |
| E | 0.033 | 0.0018 | | 20.51 | 9.1695 | Example |
| F | 0.039 | 0.0019 | Ti: 0.021, B: 0.001 | 21.20 | 10.096 | Example |
| G | 0.054 | 0.0026 | Ca: 0.002 | 21.82 | 10.914 | Example |
| H | 0.095 | 0.0036 | Nb: 0.019, Ca: 0.001 | 21.95 | 10.512 | Example |
| I | 0.066 | 0.0030 | W: 0.270 | 22.40 | 10.425 | Example |
| J | 0.069 | 0.0016 | B: 0.001 | 23.33 | 10.4495 | Example |
| K | 0.056 | 0.0028 | | 22.44 | 12.387 | Comparative Example |
| L | 0.106 | 0.0017 | | 18.78 | 7.064 | Comparative Example |
| M | 0.042 | 0.0024 | Ti: 0.024 | 18.28 | 8.4245 | Comparative Example |
| N | 0.059 | 0.0026 | | 18.56 | 9.982 | Comparative Example |
| O | 0.058 | 0.0034 | | 18.64 | 8.576 | Comparative Example |
| P | 0.062 | 0.0028 | Nb: 0.033 | 21.52 | 12.1545 | Comparative Example |
| Q | 0.038 | 0.0019 | — | 19.10 | 9.45 | Comparative Example |

*Expression (1) = (Cr) + 0.65 (Ni) + 0.6 (Mo) + 0.55 (Cu) − 20 (C)

**Expression (2) = (Cr) + (Mo) + 0.3 (Si) − 43.5 (C) − 0.4 (Mn) − (Ni) − 0.3 (Cu) − 9 (N)

TABLE 2

| Steel | | Cooling after | Quenching | | Tempering | | Hot work- | Corrosion resistance | | |
|---|---|---|---|---|---|---|---|---|---|---|
| pipe No. | Steel No. | pipe-making | Temp (° C.) | Cool-ing | Temp (° C.) | Cool-ing | ability Crack | Corrosion rate (mm/yr) | Pitting | Remarks |
| 1 | A | Air | 920 | Air | 600 | Air | Good | 0.113 | Good | Example |
| 2 | B | Air | 920 | Air | 600 | Air | Good | 0.102 | Good | Example |
| 3 | C | Air | 920 | Air | 600 | Air | Good | 0.091 | Good | Example |
| 4 | D | Air | 920 | Air | 600 | Air | Good | 0.092 | Good | Example |
| 5 | E | Air | 920 | Air | 600 | Air | Good | 0.091 | Good | Example |
| 6 | F | Air | 920 | Air | 600 | Air | Good | 0.063 | Good | Example |
| 7 | G | Air | 920 | Air | 600 | Air | Good | 0.061 | Good | Example |
| 8 | H | Air | 920 | Air | 600 | Air | Good | 0.045 | Good | Example |
| 9 | I | Air | 920 | Air | 600 | Air | Good | 0.036 | Good | Example |
| 10 | J | Air | 920 | Air | 600 | Air | Good | 0.044 | Good | Example |
| 11 | K | Air | 920 | Air | 600 | Air | Bad | 0.036 | Good | Comparative Example |
| 12 | L | Air | 920 | Air | 600 | Air | Good | 0.149 | Good | Comparative Example |
| 13 | M | Air | 920 | Air | 600 | Air | Good | 0.162 | Good | Comparative Example |
| 14 | N | Air | 920 | Air | 600 | Air | Good | 0.132 | Good | Comparative Example |
| 15 | O | Air | 920 | Air | 600 | Air | Bad | 0.179 | Bad | Comparative Example |
| 16 | P | Air | 920 | Air | 600 | Air | Good | 0.078 | Good | Comparative Example |

TABLE 2-continued

| Steel pipe No. | Steel No. | Cooling after pipe-making | Quenching Temp (° C.) | Quenching Cooling | Tempering Temp (° C.) | Tempering Cooling | Hot work-ability Crack | Corrosion resistance Corrosion rate (mm/yr) | Corrosion resistance Pitting | Remarks |
|---|---|---|---|---|---|---|---|---|---|---|
| 17 | Q | Air | 920 | Air | 600 | Air | Good | 0.119 | Bad | Comparative Example |
| 18 | A | Air | — | — | 600 | Air | Good | 0.107 | Good | Example |

Each example exhibited no occurrence of cracks in the steel pipe surfaces, a low corrosion rate, and no occurrence of pitting. Hence, it has been shown that the steel pipes of these examples have a superior hot workability and a superior corrosion resistance in a severe, corrosive environment at a high temperature of 230° C. containing $CO_2$. In contrast, comparative examples outside the scope of this disclosure exhibited occurrence of cracks, thus showing a reduced hot workability, or exhibited a high corrosion rate, thus showing a reduced corrosion resistance. In particular, there were surface flaws in the steel pipes of comparative examples not satisfying expression (2) due to a reduced hot workability.

Example 2

After sufficient degassing, each molten steel having a composition shown in Table 3 was cast into a steel ingot of 100 kgf (980 N). The ingot was formed into a seamless steel pipe with an outer diameter of 3.3 in. by a thickness of 0.5 in. with a model seamless rolling mill.

After the pipe making, the hot workability was evaluated by visually observing the presence of cracks in the internal and external surfaces of the resulting seamless steel pipe.

The seamless steel pipe was cut into a test piece. The test piece was subjected to quenching and tempering under the conditions shown in Table 4. An ark-shaped API tensile test piece was taken from the quench-tempered test piece and subjected to a tensile test for the tensile properties (yield strength YS, tensile strength TS). Also, a corrosion-test piece of 3 mm in thickness by 30 nm in width by 40 mm in length was taken from the foregoing quench-tempered test piece by machining, and was subjected to a corrosion test.

In the corrosion test, the test piece was immersed in a test solution being 20% NaCl aqueous solution placed in an autoclave (solution temperature: 230° C., $CO_2$ gas atmosphere at a pressure of 30 atmospheres) and was allowed to keep for 2 weeks.

The test piece after the corrosion test was weighed, and the corrosion rate was obtained from the difference between the weight of the corrosion test piece before the test and that after the test. The surface of the corrosion test piece after the test was observed to check for the occurrence of pitting with a loupe of a magnification of 10 times. The results are shown in Table 4.

TABLE 3

| Steel No. | Chemical compositions (mass %) C | Si | Mn | P | S | Al | Cr | Ni | Mo | Cu | V | N |
|---|---|---|---|---|---|---|---|---|---|---|---|---|
| 2A | 0.025 | 0.19 | 0.34 | 0.02 | 0.001 | 0.01 | 14.7 | 6.20 | 1.90 | 0.65 | 0.044 | 0.059 |
| 2B | 0.022 | 0.29 | 0.49 | 0.02 | 0.001 | 0.01 | 14.9 | 5.85 | 1.94 | 0.65 | 0.049 | 0.078 |
| 2C | 0.034 | 0.18 | 0.56 | 0.02 | 0.001 | 0.02 | 14.9 | 6.13 | 2.06 | 0.71 | 0.035 | 0.045 |
| 2D | 0.028 | 0.31 | 0.41 | 0.01 | 0.002 | 0.01 | 15.1 | 7.03 | 1.63 | 0.58 | 0.059 | 0.052 |
| 2E | 0.015 | 0.17 | 0.36 | 0.02 | 0.001 | 0.02 | 15.4 | 6.17 | 2.34 | 1.24 | 0.064 | 0.042 |
| 2F | 0.027 | 0.30 | 0.35 | 0.02 | 0.001 | 0.01 | 16.8 | 7.06 | 1.71 | 0.62 | 0.080 | 0.320 |
| 2G | 0.017 | 0.25 | 0.44 | 0.01 | 0.001 | 0.01 | 16.7 | 6.29 | 1.77 | 0.91 | 0.040 | 0.062 |
| 2H | 0.028 | 0.24 | 0.39 | 0.01 | 0.001 | 0.02 | 17.2 | 6.34 | 1.59 | 0.74 | 0.037 | 0.099 |
| 2I | 0.035 | 0.35 | 0.39 | 0.02 | 0.001 | 0.01 | 17.1 | 5.96 | 2.81 | 0.63 | 0.049 | 0.029 |
| 2J | 0.046 | 0.30 | 0.40 | 0.02 | 0.001 | 0.01 | 13.4 | 5.30 | 2.57 | 2.48 | 0.062 | 0.053 |
| 2K | 0.023 | 0.25 | 0.36 | 0.01 | 0.002 | 0.01 | 14.3 | 5.05 | 1.55 | 0.59 | 0.056 | 0.059 |
| 2L | 0.035 | 0.26 | 0.45 | 0.02 | 0.002 | 0.02 | 15.4 | 4.06 | 1.63 | 0.53 | 0.051 | 0.071 |

| Steel No. | Chemical compositions (mass %) O | Nb | Ti | Other | Expression (1)* | Expression (2)** | Remarks |
|---|---|---|---|---|---|---|---|
| 2A | 0.0019 | 0.074 | — | — | 19.84 | 8.45 | Example |
| 2B | 0.0015 | — | 0.077 | — | 19.78 | 9.03 | Example |
| 2C | 0.0021 | 0.049 | 0.072 | — | 19.83 | 8.56 | Example |
| 2D | 0.0027 | 0.087 | — | Zr: 0.061 | 20.41 | 7.77 | Example |
| 2E | 0.0047 | 0.038 | 0.075 | B: 0.001 | 21.20 | 10.07 | Example |
| 2F | 0.0026 | 0.089 | 0.036 | Ca: 0.003 | 22.22 | 7.16 | Example |
| 2G | 0.0017 | 0.087 | 0.042 | W: 0.220 | 22.01 | 10.51 | Example |
| 2H | 0.0028 | — | 0.150 | Zn: 0.083<br>Ca: 0.001 | 22.12 | 10.04 | Example |
| 2I | 0.0051 | 0.078 | — | — | 22.31 | 11.93 | Comparative Example |
| 2J | 0.0026 | — | 0.062 | — | 18.83 | 7.38 | Comparative Example |

TABLE 3-continued

| | | | | | | | |
|---|---|---|---|---|---|---|---|
| 2K | 0.0022 | 0.073 | 0.047 | Zr: 0.024 | 18.38 | 9.02 | Comparative Example |
| 2L | 0.0019 | 0.049 | 0.023 | Ca: 0.003 | 18.61 | 10.55 | Comparative Example |

*Expression (1) = (Cr) + 0.65 (Ni) + 0.6 (Mo) + 0.55 (Cu) − 20 (C)
**Expression (2) = (Cr) + (Mo) + 0.3 (Si) − 43.5 (C) − 0.4 (Mn) − (Ni) − 0.3 (Cu) − 9 (N)

TABLE 4

| Steel | | Cooling after | Quenching | Tempering | Tensile properties | | Hot work- | Corrision resistance | | |
|---|---|---|---|---|---|---|---|---|---|---|
| pipe No. | Steel No. | pipe-making | Temp (° C.) Cooling | Temp (° C.) Cooling | YS MPa | TS MPa | ability Crack | Corrosion rate (mm/yr) | Pitting | Remarks |
| 21 | 2A | Air | 890Air | 530Air | 910 | 1138 | Good | 0.115 | Good | Example |
| 22 | 2A | Air | 890Air | 610Air | 874 | 1110 | Good | 0.112 | Good | Example |
| 23 | 2B | Air | 890Air | 530Air | 926 | 1123 | Good | 0.109 | Good | Example |
| 24 | 2B | Air | 890Air | 610Air | 891 | 1049 | Good | 0.118 | Good | Example |
| 25 | 2C | Air | 890Air | 580Air | 892 | 1032 | Good | 0.104 | Good | Example |
| | 2D | Air | 890Air | 580Air | 821 | 1004 | Good | 0.065 | Good | Example |
| 27 | 2E | Air | 890Air | 580Air | 836 | 966 | Good | 0.071 | Good | Example |
| 28 | 2F | Air | 890Air | 580Air | 715 | 884 | Good | 0.053 | Good | Example |
| 29 | 2G | Air | 890Air | 580Air | 723 | 901 | Good | 0.049 | Good | Example |
| 30 | 2H | Air | 890Air | 580Air | 720 | 877 | Good | 0.051 | Good | Example |
| 31 | 2I | Air | 890Air | 580Air | 713 | 864 | Bad | 0.056 | Good | Comparative Example |
| 32 | 2J | Air | 890Air | 580Air | 908 | 1073 | Good | 0.172 | Good | Comparative Example |
| 33 | 2K | Air | 890Air | 580Air | 875 | 943 | Good | 0.148 | Good | Comparative Example |
| 34 | 2L | Air | 890Air | 580Air | 892 | 968 | Good | 0.162 | Good | Comparative Example |
| 35 | 2A | Air | 780Air | 600Air | 469 | 934 | Good | 0.109 | Good | Example |
| 36 | 2B | Air | 760Air | 600Air | 492 | 972 | Good | 0.113 | Good | Example |
| 37 | 2G | Air | 890Air | 650Air | 603 | 783 | Good | 0.044 | Good | Example |
| 38 | 2H | Air | 910Air | 640Air | 613 | 768 | Good | 0.046 | Good | Example |

Each example exhibited no occurrence of cracks in the steel pipe surfaces, a low corrosion rate, and no occurrence of pitting. Hence, it was shown that the steel pipes of these examples had a superior hot workability and a superior corrosion resistance in a severe, corrosive environment at a high temperature of 230° C. containing $CO_2$. In contrast, comparative examples outside the scope of this disclosure exhibited occurrence of cracks, thus showing a reduced hot workability, or exhibited a high corrosion rate, thus showing a reduced corrosion resistance. When the manufacture conditions were outside the preferred ranges as set forth, the strength was reduced and, accordingly, a high yield strength of 654 MPa or more was not achieved.

Example 3

After sufficient degassing, each molten steel having a composition shown in Table 5 was cast into a steel ingot of 100 kgf (980 N). The ingot was formed into a seamless steel pipe with an outer diameter of 3.3 in. by a thickness of 0.5 in. with a model seamless rolling mill.

The hot workability was evaluated by visually observing the presence of cracks in the internal and external surfaces of the resulting seamless steel pipe, as in Example 1.

The seamless steel pipe was cut into a test piece. The test piece was subjected to quenching and tempering under the conditions shown in Table 6. It was ensured that quenching was performed on each sample at a temperature of its $A_{C3}$ transformation point or more, and that tempering was performed at a temperature of its $A_{C1}$ transformation point or less. A structure observation test piece was taken from the quench-tempered test piece. The structure observation test piece was etched by aqua regia. The resulting structure was observed with a scanning electron microscope (1000 times), and the percentage of the ferrite phase (percent by volume) was computed with an image analysis system. The percentage of the residual austenite phase was determined by X-ray diffraction.

An ark-shaped API tensile test piece was taken from the quench-tempered test piece and subjected to a tensile test for the tensile properties (yield strength YS, tensile strength TS), as in Example 1. Also, a V-notch test piece (thickness: 5 mm) was taken from the quench-tempered test piece, in accordance with JIS Z 2202, and the Charpy impact test was performed on the V-notch test piece to determine the absorption energy $vE_{-40}$ (J) at −40° C. in accordance with JIS Z 2242.

Furthermore, a corrosion-test piece of 3 mm in thickness by 30 mm in width by 40 mm in length was taken from the foregoing quench-tempered test piece by machining, and was subjected to a corrosion test, as in Example 2.

In the corrosion test, the test piece was immersed in a test solution being 20% NaCl aqueous solution placed in an autoclave (solution temperature: 230° C., $CO_2$ gas atmosphere at a pressure of 30 atmospheres) and was allowed to keep for 2 weeks.

The test piece after the corrosion test was weighed, and the corrosion rate was obtained from the difference between the weight of the test piece before the test and that after the test.

The surface of the corrosion test piece after the test was observed to check for the occurrence of pitting with a loupe of a magnification of 10 times.

The results are shown in Table 6.

TABLE 5

| Steel No. | Chemical compositions (mass %) C | Si | Mn | P | S | Al | Cr | Ni | Mo | Cu | V |
|---|---|---|---|---|---|---|---|---|---|---|---|
| 3A | 0.027 | 0.24 | 0.31 | 0.02 | 0.001 | 0.01 | 15.2 | 6.14 | 1.60 | 0.82 | 0.039 |
| 3B | 0.024 | 0.21 | 0.34 | 0.02 | 0.001 | 0.01 | 14.9 | 5.50 | 1.50 | 1.22 | 0.051 |
| 3C | 0.018 | 0.23 | 0.36 | 0.01 | 0.002 | 0.01 | 16.1 | 6.22 | 1.62 | 1.09 | 0.059 |
| 3D | 0.028 | 0.20 | 0.41 | 0.02 | 0.001 | 0.02 | 15.1 | 5.59 | 2.49 | 1.63 | 0.048 |
| 3E | 0.017 | 0.25 | 0.29 | 0.02 | 0.001 | 0.01 | 16.8 | 6.26 | 1.57 | 0.85 | 0.042 |
| 3G | 0.032 | 0.26 | 0.33 | 0.02 | 0.001 | 0.01 | 13.7 | 6.19 | 1.97 | 0.71 | 0.055 |
| 3H | 0.035 | 0.31 | 0.29 | 0.02 | 0.002 | 0.01 | 14.5 | 5.11 | 1.55 | 0.59 | 0.048 |

| Steel No. | Chemical compositions (mass %) N | O | Other | Expression (1)* | Expression (2)** | Remarks |
|---|---|---|---|---|---|---|
| 3A | 0.049 | 0.0021 | — | 20.06 | 8.75 | Example |
| 3B | 0.062 | 0.0025 | Nb: 0.077 | 19.57 | 8.86 | Example |
| 3C | 0.043 | 0.0037 | Zr: 0.017, Ca: 0.002 | 21.35 | 9.93 | Example |
| 3D | 0.072 | 0.0021 | Ti: 0.034, Nb: 0.058 | 20.56 | 9.54 | Example |
| 3E | 0.069 | 0.0016 | B: 0.001, W: 0.19 | 21.94 | 10.45 | Example |
| 3G | 0.106 | 0.0017 | — | 18.66 | 6.87 | Comparative Example |
| 3H | 0.042 | 0.0024 | Ti: 0.024 | 18.38 | 8.94 | Comparative Example |

*Expression (1) = (Cr) + 0.65 (Ni) + 0.6 (Mo) + 0.55 (Cu) − 20 (C)

**Expression (2) = (Cr) + (Mo) + 0.3 (Si) − 43.5 (C) − 0.4 (Mn) − (Ni) − 0.3 (Cu) − 9 (N)

TABLE 6

| Steel pipe No. | Steel No. | Cooling after Pipe-making | Quenching Temp (° C.) | Quenching Cooling | Tempering Temp (° C.) | Tempering Cooling | Structure γ quantity vol % | Structure α quantity vol % | Tensile properties YS MPa | Tensile properties TS MPa | Impact property Absorbed energy $E_{40}$J | Hot workability Crack | Corrosion resistance Corrosion rate (mm/yr) | Corrosion resistance Pitting | Remarks |
|---|---|---|---|---|---|---|---|---|---|---|---|---|---|---|---|
| A1 | 3A | Air | 890 | Air | 550 | Air | 7.1 | — | 868 | 1021 | 80.2 | Good | 0.109 | Good | Example |
| A2 | 3A | Air | 890 | Air | 600 | Air | 10.9 | — | 792 | 1047 | 86.1 | Good | 0.107 | Good | Example |
| A3 | 3B | Air | 890 | Air | 500 | Air | 6.3 | 0.3 | 889 | 1061 | 83.4 | Good | 0.111 | Good | Example |
| A4 | 3B | Air | 890 | Air | 600 | Air | 11.2 | 0.7 | 847 | 1030 | 85.7 | Good | 0.112 | Good | Example |
| A5 | 3C | Air | 890 | Air | 550 | Air | 12.5 | 1.5 | 820 | 1035 | 91.2 | Good | 0.058 | Good | Example |
| A6 | 3D | Air | 890 | Air | 550 | Air | 16.3 | 1.9 | 771 | 974 | 95.4 | Good | 0.102 | Good | Example |
| A7 | 3E | Air | 890 | Air | 550 | Air | 22.7 | 3.8 | 723 | 982 | 95.9 | Good | 0.039 | Good | Example |
| A8 | 3D | Air | 890 | Air | 650 | Air | 26.3 | 1.7 | 634 | 915 | 104.3 | Good | 0.105 | Good | Example |
| A9 | 3E | Air | 890 | Air | 650 | Air | 29.6 | 4.0 | 599 | 907 | 107.6 | Good | 0.037 | Good | Example |
| A10 | 3F | Air | 890 | Air | 500 | Air | 3.2 | 5.4 | 999 | 1149 | 42.3 | Bad | 0.096 | Good | Comparative Example |
| A11 | 3G | Air | 890 | Air | 550 | Air | 6.1 | — | 875 | 1095 | 79.3 | Good | 0.179 | Bad | Comparative Example |
| A12 | 3H | Air | 890 | Air | 540 | Air | 7.3 | 2.7 | 827 | 1046 | 77.0 | Good | 0.150 | Good | Comparative Example |
| A13 | 3A | Air | 890 | Air | 450 | Air | — | — | 949 | 1018 | 37.5 | Good | 0.124 | Good | Example |

γ: residual austenite,
α: ferrite (δ)

Each example exhibited no occurrence of cracks in the steel pipe surfaces, a low corrosion rate, and no occurrence of pitting; hence it was shown that steel pipes of these examples had a superior hot workability. In addition, their structure containing 5 to 25 percent by volume of residual austenite phase, or further containing 5 percent by volume or less of ferrite phase leads to a superior corrosion resistance in a severe, corrosive environment at a high temperature of 230° C. containing $CO_2$. Furthermore, the strength is as high as 654 MPa or more in terms of yield strength YS and the toughness is as high as 60 J or more in terms of absorbed energy at −40° C.

In contrast, comparative examples outside the scope of this disclosure exhibited occurrence of cracks, thus showing a reduced hot workability, or exhibited a high corrosion rate, thus showing a reduced corrosion resistance. When the manufacture conditions were outside the preferred ranges, the strength was decreased and, accordingly, a high yield strength of 654 MPa or more was not achieved.

INDUSTRIAL APPLICABILITY

A high-strength martensitic stainless steel pipe for oil country tubular goods can be manufactured at a low cost with stability which has a sufficient corrosion resistance in severe, corrosive environments at high temperatures containing $CO_2$ or $Cl^-$ or which has a high toughness in addition to such a sufficient corrosion resistance, thus producing particularly advantageous industrial effects.

The invention claimed is:

1. A corrosion-resistant seamless stainless steel pipe for oil country tubular goods having a steel composition comprising on a mass basis:

0.05% or less of C;
0.50% or less of Si;
0.20% to 1.80% of Mn;
0.03 or less of P;
0.005% or less of S;
14.0% to 18.0% of Cr;
5.0% to 8.0% of Ni;
1.5% to 3.5% of Mo;
0.5% to 3.5% of Cu;
0.05% or less of Al;
0.03% to 0.20% of V;
0.01% to 0.15% of N;
0.006% or less of O, and
the balance being Fe and incidental impurities, wherein the composition satisfies expressions (1) and (2):

$$Cr+0.65Ni+0.6Mo+0.55Cu+20C \geqq 18.5 \quad (1);$$

$$Cr+Mo+0.3Si-43.5C-0.4Mn-Ni-0.3Cu-9N \leqq 11 \quad (2),$$

where Cr, Ni, Mo, Cu, C, Si, Mn, and N represent the respective contents thereof on a mass % basis, and the structure of the stainless steel pipe includes 5 to 25 percent by volume of a residual austenite phase and the balance being a martensite phase.

2. The pipe according to claim 1, wherein the composition further comprises at least one element selected from the group consisting of 0.20% or less of Nb and 0.30% or less of Ti on a mass basis.

3. The pipe according to claim 1 or 2, wherein the composition further comprises at least one element selected from the group consisting of 0.20% or less of Zr, 0.01% or less of B, and 3.0% or less of W on a mass basis.

4. The pipe according to claim 1, wherein the composition further comprises 0.0005% to 0.01% of Ca on a mass basis.

5. The pipe according to claim 1, wherein the structure thereof includes, on a volume basis, 5 percent by volume or less of a ferrite phase, and the balance being a martensite phase.

6. The pipe according to claim 1, wherein the structure includes 10.9% to 25% of the residual austenite phase.

7. A method for manufacturing a corrosion-resistant seamless stainless steel pipe for oil country tubular goods comprising: 1) forming a seamless steel pipe from a steel pipe material having a composition; 2) quenching the steel pipe by heating the steel pipe to a temperature of the $A_{C3}$ transformation point thereof or more; 3) subsequently cooling to room temperature at air-cooling speed or more; and 4) tempering the steel pipe at a temperature of the $A_{C1}$ transformation point thereof or less, wherein the composition comprises on a mass basis:

0.05% or less of C;
0.50% or less of Si;
0.20% to 1.80% of Mn;
0.03 or less of P;
0.005% or less of S;
14.0% to 18.0% of Cr;
5.0% to 8.0% of Ni;
1.5% to 3.5% of Mo;
0.5% to 3.5% of Cu;
0.05% or less of Al;
0.03% to 0.20% of V;
0.01% to 0.15% of N;
0.006% or less of O, and
the balance being Fe and incidental impurities, the composition satisfies expressions (1) and (2):

$$Cr+0.65Ni+0.6Mo+0.55Cu+20C \geqq 18.5 \quad (1);$$

$$Cr+Mo+0.3Si-43.5C-0.4Mn-Ni-0.3Cu-9N \leqq 11 \quad (2),$$

where Cr, Ni, Mo, Cu, C, Si, Mn, and N represent the respective contents thereof on a mass % basis, and the structure of the stainless steel pipe includes 5 to 25 percent by volume of a residual austenite phase and the balance being a martensite phase.

8. The method according to claim 7, wherein the composition further comprises at least one element of 0.20% or less of Nb and 0.30% or less of Ti on a mass basis.

9. The method according to claim 8 wherein the quenching includes heating to a temperature in the range of 800 to 1100° C. and cooling to room temperature at air-cooling speed or more, and the tempering is performed at a temperature in the range of 500 to 630° C.

10. The method according to claim 9, wherein the composition further comprises at least one element selected from the group consisting of 0.20% or less of Zr, 0.01% or less of B, and 3.0% or less of W on a mass basis.

11. The method according to claim 7, wherein the composition further comprises at least one element selected from the group consisting of 0.20% or less of Zr, 0.01% or less of B, and 3.0% or less of W on a mass basis.

12. The method according to claim 7, wherein the composition further comprises 0.0005% to 0.01% of Ca on a mass basis.

13. The method according to claim 8, wherein the composition further comprises at least one element selected from the group consisting of 0.20% or less of Zr, 0.01% or less of B, and 3.0% or less of W on a mass basis.

14. The method according to claim 7, wherein the structure includes 10.9% to 25% of the residual austenite phase.

15. A method for manufacturing a corrosion-resistant seamless stainless steel pipe for oil country tubular goods comprising: forming a steel pipe from a steel pipe material having a composition by hot working; cooling the steel pipe to room temperature at air-cooling speed or more, or quenching the steel pipe by further heating to a temperature of the $A_{C3}$ transformation point thereof or more and cooling to room temperature at air-cooling speed or more; and tempering the steel pipe at a temperature of the $A_{C1}$ transformation point thereof or less, wherein the composition comprises on a mass basis:

0.05% or less of C;
0.50% or less of Si;
0.20% to 1.80% of Mn;
0.03 or less of P;

0.005% or less of S;
14.0% to 18.0% of Cr;
5.0% to 8.0% of Ni;
1.5% to 3.5% of Mo;
0.5% to 3.5% of Cu;
0.05% or less of Al;
0.03% to 0.20% of V;
0.01% to 0.15% of N;
0.006% or less of O, and
the balance being Fe and incidental impurities, and the composition satisfies expressions (1) and (2):

$$Cr+0.65Ni+0.6Mo+0.55Cu+20C \geqq 18.5 \quad (1);$$

$$Cr+Mo+0.3Si-43.5C-0.4Mn-Ni-0.3Cu-9N \leqq 11 \quad (2),$$

where Cr, Ni, Mo, Cu, C, Si, Mn, and N represent the respective contents thereof on a mass % basis, and the structure of the stainless steel pipe includes 5 to 25 percent by volume of a residual austenite phase and the balance being a martensite phase.

16. The method according to claim 15, wherein the composition further comprises at least one element of 0.20% or less of Nb and 0.30% or less of Ti on a mass basis.

17. The method according to claim 16, wherein the quenching includes heating to a temperature in the range of 800 to 1100° C. and cooling to room temperature at air-cooling speed or more, and the tempering is performed at a temperature in the range of 500 to 630° C.

18. The method according to claim 17, wherein the composition further comprises at least one element selected from the group consisting of 0.20% or less of Zr, 0.01% or less of B, and 3.0% or less of W on a mass basis.

19. The method according to claim 16, wherein the composition further comprises at least one element selected from the group consisting of 0.20% or less of Zr, 0.01% or less of B, and 3.0% or less of W on a mass basis.

20. The method according to claim 15, wherein the composition further comprises at least one element selected from the group consisting of 0.20% or less of Zr, 0.01% or less of B, and 3.0% or less of W on a mass basis.

21. A method for manufacturing a seamless stainless steel pipe for oil country tubular goods according to claim 15, wherein the composition further comprises 0.0005% to 0.01% of Ca on a mass basis.

22. The method according to claim 15, wherein the structure includes 10.9% to 25% of the residual austenite phase.

* * * * *